US006209426B1

(12) United States Patent
Takahashi

(10) Patent No.: US 6,209,426 B1
(45) Date of Patent: Apr. 3, 2001

(54) MAGNETICALLY ATTRACTIVE DRIVER BIT ASSEMBLY

(75) Inventor: Yuji Takahashi, Nagoya (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 09/496,093

(22) Filed: Feb. 1, 2000

(30) Foreign Application Priority Data

Feb. 9, 1999 (JP) ..... 11-032036
Mar. 24, 1999 (JP) ..... 11-079255

(51) Int. Cl.[7] ..... B25B 23/08
(52) U.S. Cl. ..... 81/451; 81/452
(58) Field of Search ..... 81/451, 452, 436, 81/176.1

(56) References Cited

U.S. PATENT DOCUMENTS 3,707,894 * 1/1973 Stillwagon, Jr. .
4,219,062 * 8/1980 Berkman .
5,724,873 * 3/1998 Hillinger .
5,861,789 * 1/1999 Bundy et al. .

FOREIGN PATENT DOCUMENTS 46-35987 12/1971 (JP) .
57-202669 12/1982 (JP) .

* cited by examiner

*Primary Examiner*—Timothy V. Eley
*Assistant Examiner*—Willie Berry, Jr.
(74) *Attorney, Agent, or Firm*—Davis & Bujold, P.L.L.C

(57) ABSTRACT

A magnetically attractive driver bit assembly shows a strong magnetic attraction when applied to a screwing robot arm so that the operating speed of the robot arm can be increased. The magnetically attractive driver bit assembly comprises an iron driver bit having a step, formed at a predetermined distance away from the pointed edge of the tip of the driver bit, from which a larger diameter portion extends in the direction opposite to the tip. A first ring magnet having approximately the same outside diameter as that of the larger diameter portion is firstly fitted around the driver bit and then an iron cylindrical spacer having approximately the same outside diameter as that of the first ring magnet is fitted. Subsequently, a second ring magnet similar to the first ring magnet is fitted to the end of the cylindrical spacer. From the end surface of the second ring magnet is exposed a predetermined portion of a tip of the driver bit, so that a screw engaging with the tip of the driver bit is attracted by the second ring magnet. The first ring magnet may be replaced by one or more O-rings.

8 Claims, 2 Drawing Sheets

MAGNETICALLY ATTRACTIVE DRIVER BIT ASSEMBLY

FIELD OF THE INVENTION

The present invention relates to a magnetically attractive driver bit assembly.

BACKGROUND OF THE INVENTION

Conventionally, when driving a screw, devices such as one disclosed in the Japanese Utility Model Publication No. Sho 46-35987, wherein air attraction is employed to attract a screw to the tip of a driver bit, have been utilized. Also, for example, the Publication of Unexamined Japanese Utility Model Application No. Sho 57-202669 discloses a device, wherein magnetic force is employed to attract a screw to the tip of a driver bit by magnetizing the driver bit using one or more permanent magnets.

In the case where air attraction is employed, however, it is necessary to fit a device adapted for air attraction around a driver bit. Therefore, when driving a screw into an object having a counterbore, the driver bit with such a device cannot be used because the outside diameter thereof is relatively large. Moreover, since the weight of the end portion of a screwing robot is increased, it is impossible to convey a screw attracted to the driver bit from a screw supply position to a screwing position at high speed.

Prior art for magnetizing a driver bit itself has the disadvantage that the magnetic attraction of the driver bit for a screw is not strong enough to securely hold the screw. As a result, high-speed movement of a screwing robot arm from a screw supply position to a screwing position may cause the screw to drop off the driver bit and, therefore, speed-up of the screwing operation is prevented.

SUMMARY OF THE INVENTION

Wherefore, a principal object of the invention is to provide a novel driver bit assembly which comprises a driver bit and a magnetically attractive device and shows a strong magnetic attraction when applied to a screwing robot and the like so that the operating speed of the robot arm can be increased. Another object of the invention is to provide a driver bit assembly which can prevent breakage of the magnetically attractive device even when the driver bit is broken.

To attain these and other objects, there is provided a magnetically attractive driver bit assembly capable of magnetically attracting a screw, the driver bit assembly comprising: a driver bit made of a magnetic body having a tip for engaging with the screw and a peripheral portion extending from the tip to a position at a predetermined distance; a cylindrical spacer made of a magnetic body fitted around the peripheral portion of the driver bit; a fixing means for fixing the cylindrical spacer around the driver bit; and a ring magnet fixed to an end of the cylindrical spacer by means of its magnetic attraction and adapted for magnetically attracting the screw.

The fixing means is preferably another ring magnet, which is disposed between the cylindrical spacer and a step located between the above peripheral portion and a large diameter portion, and magnetically attracts both the step and the cylindrical spacer.

Alternatively, the fixing means may be an O-ring fitted on the inner surface of the cylindrical spacer, which has an annular in cross-section larger than the clearance between the inner surface of the cylindrical spacer and the outer surface of the peripheral portion of the driver bit, and which is elastically deformed to fix the cylindrical spacer on the driver bit.

Preferably, the length of the cylindrical spacer is such that, when a screw is magnetically attracted to the tip of the driver bit, the head of the screw and the ring magnet do not contact each other with a narrow gap therebetween.

In the case where an O-ring is employed as a fixing means, the length of the cylindrical spacer is such that even when the cylindrical spacer is positioned away from the step of the driver bit, the above described gap occurs between the head of the screw and the ring magnet.

BRIEF DESCRIPTION OF THE DRAWINGS

The invention will now be described, by way of example, with reference to the accompanying drawings, in which.

DETAILED DESCRIPTION OF THE PREFERRED EMBODIMENT

Preferred embodiments of the invention will be described referring to drawing figures as follows.

Figure 1:
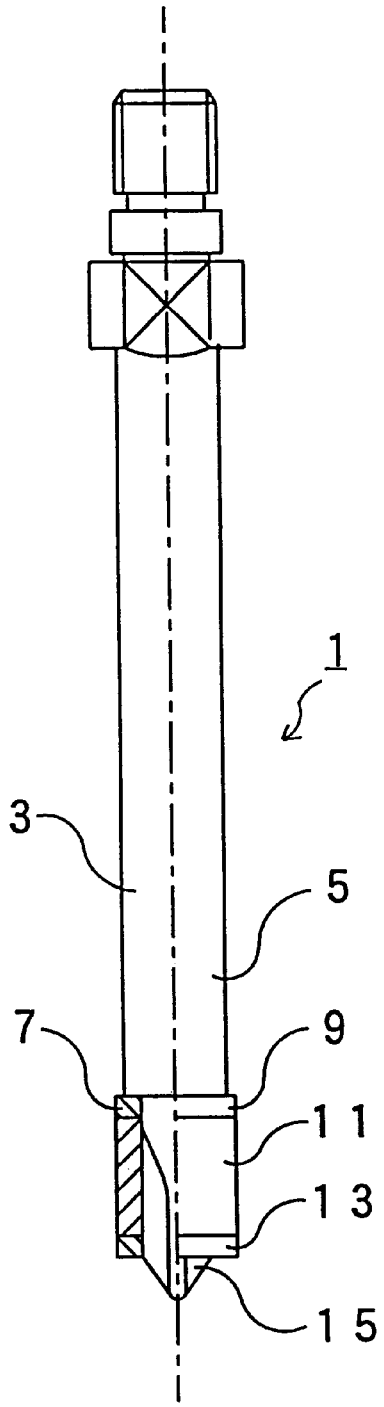
FIGS. 1 and 2 are front views, partly in cross-section, of a magnetically attractive driver bit assembly according to a first embodiment of the present invention.
Figure 2:
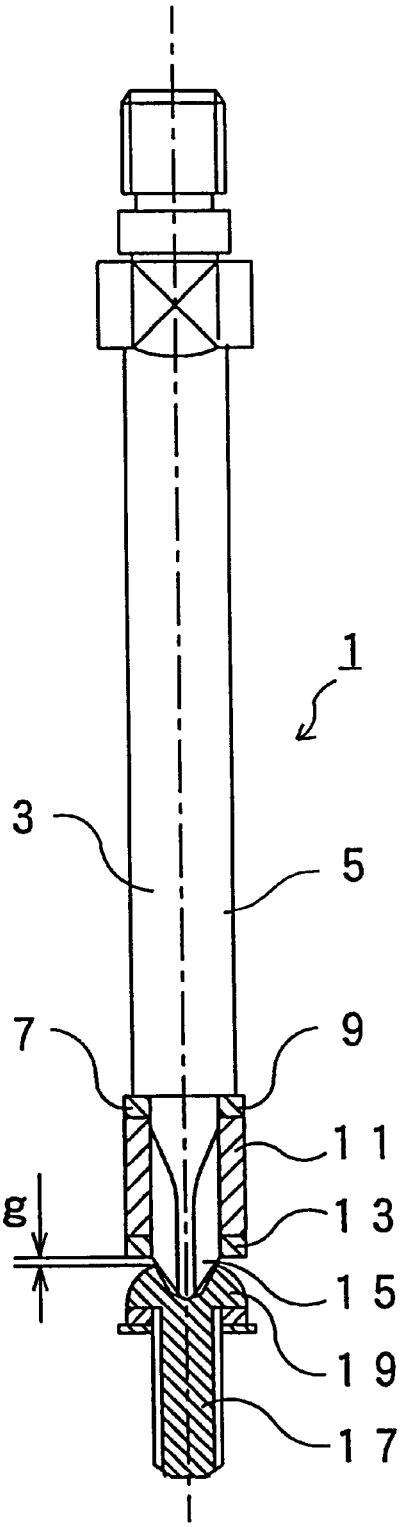

As shown in FIGS. 1 and 2, a magnetically attractive driver bit assembly 1 according to a first embodiment includes an iron driver bit 3 having a step 7, at a predetermined distance from the pointed edge of a tip 15 of the driver bit 3, from which a larger diameter portion 5 extends. A first ring magnet 9 having approximately the same outside diameter as the larger diameter portion 5 is firstly fitted around the driver bit 3 from the direction of the pointed tip thereof, and an iron cylindrical spacer 11 having approximately the same outside diameter as the first ring magnet 9 is then fitted. A second ring magnet 13 similar to the first ring magnet 9 is then fitted to the end of the cylindrical spacer 11. From the end surface of the second ring magnet 13 is exposed a portion of the tip 15 (a Phillips screwdriver tip) of the driver bit 3, so that a screw 17 engaging with the tip 15 of the driver bit 3 is attracted by the second ring magnet 13.

In the magnetically attractive driver bit assembly 1, the length of the cylindrical spacer 11 is determined such that when the screw 17 is engaged with and attracted to the tip 15 of the driver bit 3, a narrow gap g (about 0.3 mm) is formed between the head 19 of the screw 17 and the second ring magnet 13 instead of allowing direct contact thereof with each other.

Also, respective outside diameters of the larger diameter portion 5, the first ring magnet 9, the second ring magnet 13, and the cylindrical spacer 11 are approximately the same and smaller than the diameter of even a deep counterbore formed on an object in which the screw is to be installed.

Rare earth magnets (neodymium magnets) are employed as the first and the second ring magnets 9, 13 to provide a strong magnetic force to allow fast operation of a screwing robot.

The above described constitution enables the magnetically attractive driver bit assembly 1 of the first embodiment to attract the screw 17 in securely engaging relation to the tip 15 of the driver bit 3 by the magnetic attraction of the second ring magnet 13 disposed near the tip 15 of the driver bit 3. As a result, when applied to a screwing robot, the magnetically attractive driver bit assembly 1 enables the movement of the robot arm from a screw supply position to a screwing position to be quickened. Also, the first ring magnet 9 is attracted to the step 7 of the driver bit 3, the cylindrical spacer 11 is attracted to the first ring magnet 9, and the second ring magnet 13 is attracted to the cylindrical spacer 11, and ring magnets 9, 13 can be easily detached. Furthermore, even when fatigue failure of the driver bit 3 occurs, the first and the second ring magnets 9, 13 and the cylindrical spacer 11 can be used again by removing them from the broken driver bit and fitting them around a replacement driver bit.

By providing a narrow gap g between the second ring magnet 13 and the head 19 of the screw 17, as described above, the second ring magnet 13 and the head 19 of the screw 17 do not directly contact with each other, and thus wear or damage thereof due to rubbing against each other during a screwing operation is prevented. In the first embodiment, wherein desired magnetic attraction is effected by the first and the second ring magnets 9, 13 and the length of the cylindrical spacer 11 therebetween, by changing the length of the cylindrical spacer 11, similar operation can be achieved regardless of the size of a screw (i.e. the depth of the cross-shaped slot of its screw head) by adjusting the length of the spacer 11 or adjusting the position of the magnets and spaces away from the steps to adjust the gap g.

Figure 3:
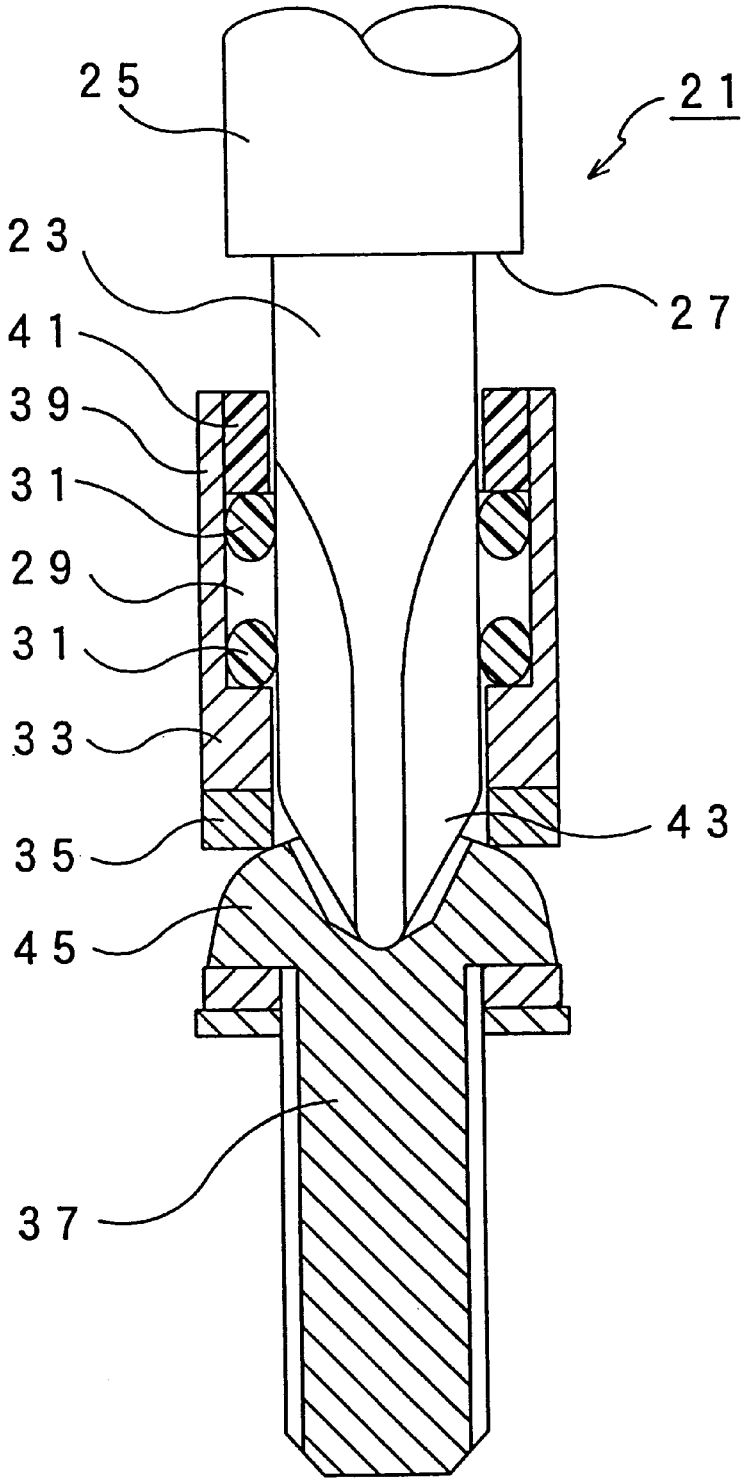
FIG. 3 is a front view, partly in cross-section, of a magnetically attractive driver bit assembly according to a second embodiment of the present invention.

As shown in FIG. 3, a magnetically attractive driver bit assembly 21 according to a second embodiment includes an iron driver bit 23 having a step 27, at a predetermined distance away from the pointed edge of a tip 43 of the driver bit 23, from which a larger diameter portion 25 extends in the direction opposite to the pointed end. Firstly, fitted to the driver bit 23 from the direction of the pointed end thereof is an iron cylindrical spacer 33, whose outside diameter is approximately the same as that of the larger diameter portion 25, and which has a recess 29 formed on its inner surface and contains rubber O-rings 31,31 that have previously been fitted therein and which elastically engage the bit 23. Secondly fitted, to the end of the cylindrical spacer 33 is a ring magnet 35 whose inside and outside diameters are approximately the same as those of the cylindrical spacer 33. From the end surface of the ring magnet 35 is exposed a predetermined portion of a tip 43 of the driver bit 23, so that a screw 37 engaging with the tip 43 of the driver bit 23 is attracted by the ring magnet 35.

The cylindrical spacer 33 includes a thinner portion 39 configured to form the recess 29 housing the O-rings 31, 31 therein while leaving the remaining of the spacer 33 portion to be attracted by the ring magnet 35. An open end of the thinner portion 39 is plugged by a ring-shaped cap 41 made of synthetic resin after installation of the O-rings 31, 31.

The cylindrical spacer 33 has an inside diameter such that a gap of about 0.05 mm occurs between the driver bit 23 and itself, and therefore can be easily fitted around the driver bit 23 from the direction of the pointed end thereof.

Also, respective outside diameters of the larger diameter portion 25, the cylindrical spacer 33 and the ring magnet 35 are approximately the same and smaller than the diameter of even a deep counterbore formed on the object in which the screw is to be installed.

A rare earth magnet (neodymium magnet) is employed as the ring magnet 35 for the same reason as in the first embodiment.

In the magnetically attractive driver bit assembly 21, the length of the cylindrical spacer 33 is determined such that a predetermined space is secured between the step 27 and the cylindrical spacer 33. As a result, if a pressure is imposed on the cylindrical spacer 33 and the ring magnet 35 from the direction of the tip 43 of the driver bit 23, the cylindrical spacer 33 and the ring magnet 35 can slidingly move a little in the direction of the larger diameter portion 25, so that a heavy load is prevented from being applied to the ring magnet 35.

The above described construction enables the magnetically attractive driver bit assembly 21 of the second embodiment to attract the screw 37 in securely engaging relation to the tip 43 of the driver bit 23 by the magnetic attraction of the ring magnet 35 disposed near the tip 43 of the driver bit 23. As a result, when applied to a screwing robot, the magnetically attractive driver bit assembly 21 enables the movement of the robot arm from a screw supply position to a screwing position to be quickened. Also, due to the structure that the cylindrical spacer 33 is fitted around the driver bit 23 via the O-rings 31,31 and the ring magnet 35 attracts the cylindrical spacer 33, the ring magnet 35 can be easily detached. Furthermore, even when fatigue failure of tip 43 of the driver bit 23 occurs and a heavy load is likely to be applied to the ring magnet 35, the cylindrical spacer 33 and the ring magnet 35 can move a little in the direction of the larger diameter portion 25 owing to the resilience of the O-rings, so that damage to the ring magnet 35 by a heavy load applied thereto is prevented. Therefore, the ring magnet 35 and the cylindrical spacer 33 can be used again by removing them from the broken driver bit and fitting them around a replacement driver bit.

It is preferable to provide a narrow gap between the ring magnet 35 and the head 45 of the screw 37 in the same way as in the first embodiment. By this, the ring magnet 35 and the screw 37 do not directly contact with each other, and wear or damage thereof due to rubbing against each other during screwing operation is prevented.

While the description above refers to particular embodiments of the invention, it will be understood that the invention is not restricted to the above described embodiments and any modification may be made without departing from the spirit and the scope of the invention.

For example, rare earth magnets other than a neodymium magnet may be employed and the ring-shaped cap made of synthetic resin in the second embodiment may be made of iron.

What is claimed is:

1. A screwdriver bit assembly capable of magnetically attracting a screw, the assembly comprising:

a driver bit made of a magnetic material having a tip for engaging a screw and a cylindrical portion extending a predetermined distance from the tip;

a cylindrical spacer composed of a magnetic material disposed around and supported on the cylindrical portion; and a ring magnet attached to an end of said cylindrical spacer by magnetic attraction for magnetically attracting a said screw;

wherein the driver bit has an annular step at the predetermined distance from the tip and a larger diameter portion, adjoining the step, having a diameter larger than the diameter of the cylindrical portion, a further ring magnet is disposed between the step and the cylindrical spacer to magnetically attract both the step and cylindrical spacer to support the spacer on the cylindrical portion.

2. The assembly according to claim 1, wherein the length of the cylindrical spacer is determined such that, when a said screw is magnetically attracted to the tip of the driver bit, the head of the screw and the ring magnet are spaced apart by a narrow gap.

3. A screwdriver bit assembly capable of magnetically attracting a screw, the assembly comprising:

a driver bit made of a magnetic material having a tip for engaging a screw and a cylindrical portion extending a predetermined distance from the tip;

a cylindrical spacer composed of a magnetic material disposed around and supported on the cylindrical portion;

a ring magnet attached to an end of said cylindrical spacer by magnetic attraction for magnetically attracting a said screw;

wherein the driver bit has an annular step at the predetermined distance from the tip and a larger diameter portion, adjoining the step, having a diameter larger than the diameter of the cylindrical portion; and an O-ring is located on an inner surface of the cylindrical spacer, the O-ring having a diameter in annular cross-section larger than clearance between the inner surface of the cylindrical spacer and the outer surface of the cylindrical portion and being elastically deformable to support the spacer on the cylindrical portion due to friction.

4. A screwdriver bit assembly capable of magnetically attracting a screw, the assembly comprising:

a driver bit made of a magnetic material having a tip for engaging a screw, a relatively small diameter portion extending a predetermined distance from the tip to an annular step, and a relatively large diameter portion extending from the step toward an end opposite to the tip;

a ring magnet magnetically attached to the step and having approximately the same diameter as that of the relatively large diameter portion of the driver;

a cylindrical spacer made of a magnetic material fitted around the relatively small diameter portion, the cylindrical spacer having approximately the same outer diameter as that of the relatively large diameter portion and a length shorter than the predetermined distance, one end of the cylindrical spacer being magnetically attracted to the ring magnet; and another ring magnet disposed at, and magnetically attracting, an opposite end of the cylindrical spacer and being capable of magnetically attracting a said screw.

5. The assembly according to claim 4, wherein the length of the cylindrical spacer is determined such that, when the screw is magnetically attracted to the tip of the driver bit, the head of the screw and the ring magnet for magnetically attracting the screw do not contact each other and a narrow gap exists therebetween.

6. A screwdriver bit assembly capable of magnetically attracting a screw, the assembly comprising:

a driver bit made of a magnetic material having a tip for engaging with a screw, a relatively small diameter portion extending a desired distance from the tip to an annular step, and a relatively large diameter portion extending from the step toward an end opposite to the tip;

a cylindrical spacer made of a magnetic material fitted around and supported on the relatively small diameter portion, the cylindrical spacer including an inner surface having an inside diameter larger than the outside diameter of the relatively small diameter portion, an outer surface having approximately the same outside diameter as the relatively large diameter portion and a length shorter than the desired distance, an O-ring being fitted on the inner surface being elastically deformed between the spacer and the relatively small diameter portion; and a ring magnet disposed at one end of the cylindrical spacer and being capable of magnetically attracting a said screw.

7. The assembly according to claim 6, wherein the length of the cylindrical spacer is determined such that, when the cylindrical spacer is fitted around the driver bit and the screw is magnetically attracted to the tip of the driver bit, the cylindrical spacer is spaced from the step and also the ring magnet does not contact with the head of the screw and a narrow gap occurs therebetween.

8. The assembly according to claim 6, wherein when the cylindrical spacer is spaced from the step, the cylindrical spacer can slidingly move along the relatively small diameter portion, overcoming the friction due to elastic deformation of the O-ring, when a force from the outside is imposed on the ring magnet and the cylindrical spacer.

* * * * *